US005433587A

United States Patent [19]

Bankert et al.

[11] Patent Number: 5,433,587

[45] Date of Patent: Jul. 18, 1995

[54] PAINT CIRCULATING METHOD WITH VISCOSITY INDICATOR AND PAINT AGITATING MEANS

[75] Inventors: Peter J. Bankert, Birmingham; Lawrence A. Gawne, Wixom, both of Mich.

[73] Assignee: Graco Inc., Minneapolis, Minn.

[21] Appl. No.: 99,901

[22] Filed: Jul. 19, 1993

[51] Int. Cl.[6] ..... F04B 49/08; F04B 41/06; B05B 12/08

[52] U.S. Cl. ..... 417/44.2; 417/53; 417/63; 417/430; 417/199.1; 137/563; 239/75; 239/101

[58] Field of Search ..... 417/44.2, 44.7, 44.8, 417/44.9, 53, 63, 199.1, 430; 137/4, 92, 563; 239/75, 126, 124, 101, 76; 73/54.13

[56] References Cited

U.S. PATENT DOCUMENTS

| | | | |
|---|---|---|---|
| 2,244,686 | 6/1941 | Garrison et al. | 239/76 |
| 2,760,832 | 8/1956 | Bidwell . | |
| 4,030,857 | 6/1977 | Smith, Jr. . | |
| 4,108,574 | 8/1978 | Bartley et al. . | |
| 4,204,808 | 5/1980 | Reese et al. | 417/53 |
| 4,238,073 | 12/1980 | Liska . | |
| 4,259,038 | 3/1981 | Jorgensen et al. | 417/53 |
| 4,376,449 | 3/1983 | Nelson et al. | 417/62 |
| 4,486,148 | 12/1984 | Battah | 417/53 |
| 4,502,842 | 3/1985 | Currier et al. | 417/53 |
| 4,653,532 | 3/1987 | Powers | 137/563 |
| 4,682,710 | 7/1987 | Turner, Jr. et al. . | |
| 4,924,180 | 5/1990 | Nasr et al. | 417/63 |
| 4,944,599 | 7/1990 | Soechtig | 137/563 |
| 4,945,942 | 8/1990 | Lund | 137/563 |
| 5,096,120 | 3/1992 | Luckarz | 239/76 |
| 5,224,835 | 7/1993 | Oltman | 417/53 |

FOREIGN PATENT DOCUMENTS

| | | | |
|---|---|---|---|
| 2710343 | 8/1978 | Germany | 417/63 |
| WO92/06364 | 4/1992 | WIPO | 73/54.13 |

*Primary Examiner*—Richard A. Bertsch
*Assistant Examiner*—Roland G. McAndrews, Jr.
*Attorney, Agent, or Firm*—Beaman & Beaman

[57] ABSTRACT

A paint circulation system for supplying paint to a plurality of distributors utilizing a circulating pump to circulate paint to the distributors and an injection pump operated by a closely controlled electric motor for injecting paint into the circulation network from a paint supply reservoir to maintain a predetermined pressure within the circulation network. A "leakage" passage having a predetermined restriction permits paint to leave the circulation network when the valved paint distributors are closed, and the use of an automatic timing valve within the leakage bypass permits flow rates within the circulation network to be varied. The components permit paint viscosity and volumes to be determined, settling of the paint particles within the circulation network and degradation of the circulating paint is minimized, and circulating motor wear may be determined. Further, the invention contemplates producing an oscillating flow within dead-end drops in a paint circulation system to prevent settling in inactive conduits.

5 Claims, 2 Drawing Sheets

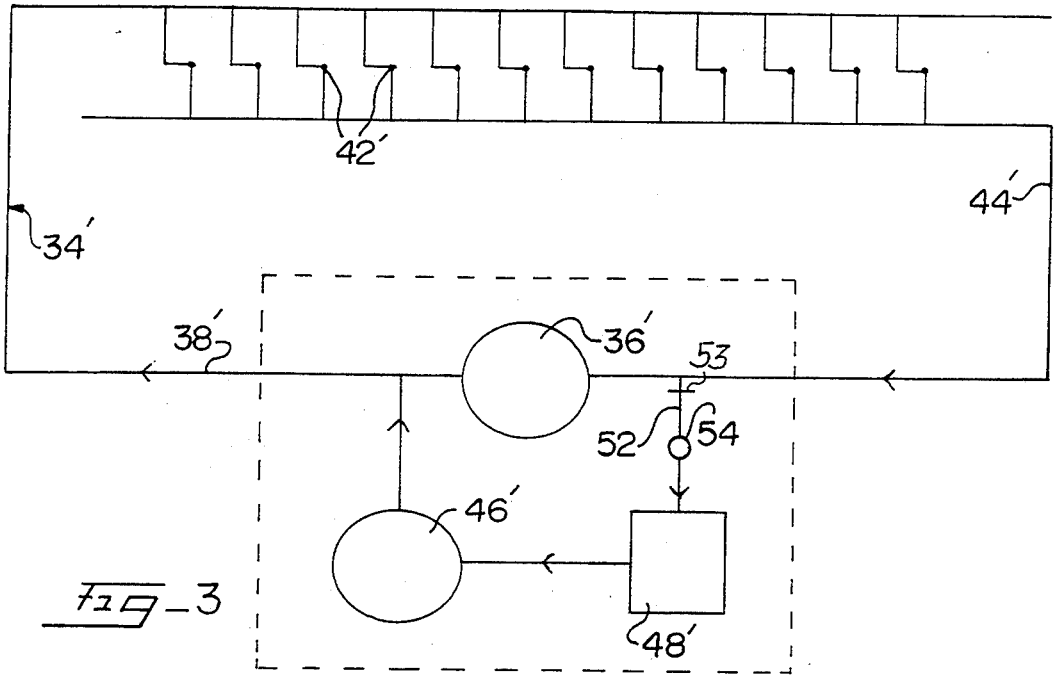
Fig-3
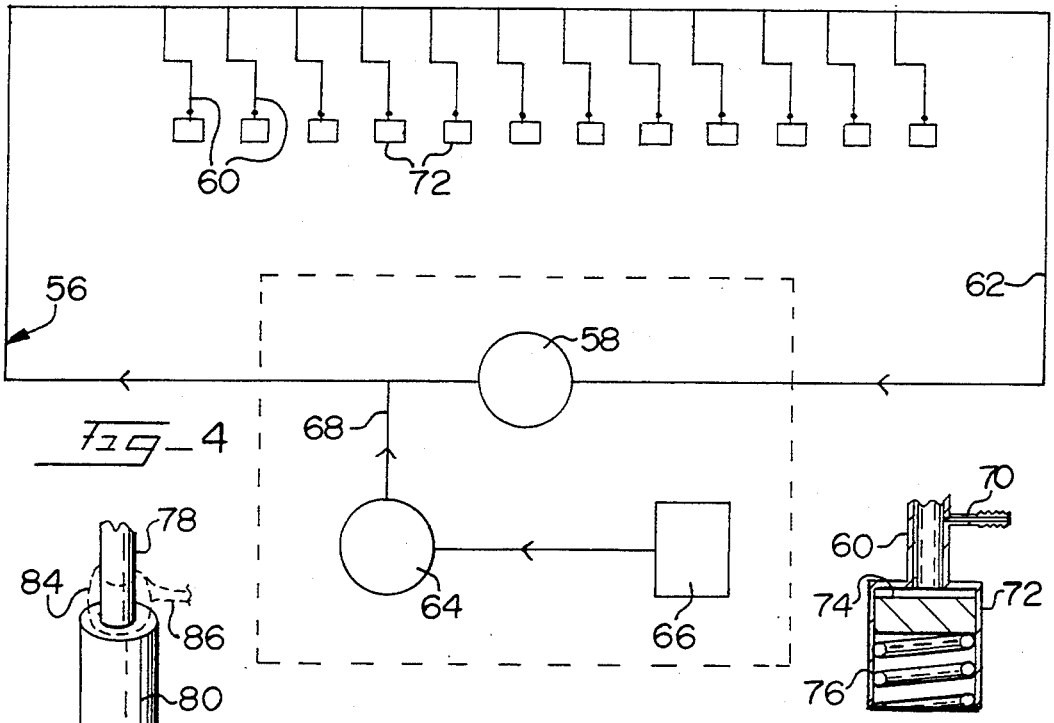
Fig-4
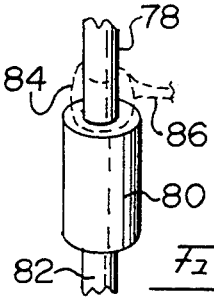
Fig-5
Fig-6

PAINT CIRCULATING METHOD WITH VISCOSITY INDICATOR AND PAINT AGITATING MEANS

BACKGROUND OF THE INVENTION

1. Field of the Invention

The invention pertains to paint circulation systems wherein makeup paint is supplied through an injection pump operated by a "smart" motor and a bypass permits a constant monitoring of the paint viscosity, volume of paint pumped, and circulating motor wear, while minimizing paint settling and degradation.

2. DESCRIPTION OF THE RELATED ART

In manufacturing operations, it is often necessary to utilize sophisticated painting systems. In such painting systems, a variety of pumps and controls are utilized therewith to control the distribution and application of paint, such as shown in U.S. Pat. Nos. 4,030,857 and 4,238,073.

In large paint systems wherein a plurality of colors are available for instant use, each color requires a separate distribution system, and, conventionally, each system will include a circulation network wherein a circulation pump causes paint to flow through the network conduits. The network includes a plurality of paint distributors, such as spray guns or spray nozzles, which may be fixed, robotically operated or hand held, and one or more of the paint distributors may be in operation at a time. It is necessary to design the circulation system to be capable of handling sufficient paint if all of the distributors are simultaneously in operation, but usually, only a small percentage of the capacity of the circulation network is being used at any one time.

Paint circulation systems are basically "closed" wherein the paint circulates in a loop, and it is necessary to add paint to the loop to replace that ejected from the nozzles. The circlation of the paint is at a high rate and the paint will be cycled many times if usage is low. Problems have been experienced with existing paint circulation systems with respect to paint particles settling within the network conduits, and degradation of the paint occurs during extended circulation, including the degradation of metallic flakes and the like which may be added to the paint for aesthetic purposes. Additionally, existing paint circulation systems do not permit a ready indication of the volume of paint being used, nor indicate the viscosity of the paint. As viscosity changes the quality of the applied paint will change, and to provide optimum results a variety of paint characteristics need to be known which are not available with conventional paint circulation systems.

In the assignee's U.S. Pat. No. 4,653,532, a paint circulation system is shown having an injector pump. However, in this system the low pressure return line from the paint distributors is directly fed into the injector pump inlet, and as such, the injector pump is supplied from both the distributor return line and a paint supply reservoir.

OBJECT OF THE INVENTION

It is an object of the invention to provide a paint circulation system wherein the circulation volume and rate of flow is at a reduced value to lower paint degradation, yet necessary spray pressures and volumes can be maintained duringn high paint usage. Another object of the invention is to provide a paint circulation system utilizing a substantially closed loop circulation network wherein the viscosity of the paint may be constantly monitored.

An additional object of the invention is to provide a paint circulation system wherein makeup paint is supplied to a circulation network through an injector pump operated by a characteristic analyzing motor which will maintain the pressure within the network substantially constant, and wherein the volume of paint being supplied to the network is measured.

Yet a further object of the invention is to provide a paint circulation system employing a circulation pump wherein makeup paint is supplied through an injector pump receiving fresh paint from a reservoir wherein the velocity of the paint within the paint circulation network may be varied to discourage the settling of paint particles, reducing degradation of the paint.

Yet another object of the invention is to provide a paint circulation system employing a circulation pump wherein makeup paint is injected into the circulation system by a positive displacement pump driven by a signal analyzing electric motor which provides outputs pertaining to paint volume being utilized, paint viscosity and bearing wear characteristics of the circulating pump.

Yet an additional object of the invention is to provide a circulating paint system having a plurality of dead-end drops wherein an oscillating reservoir is employed at the terminating end of the dead-end drop sensitive to pressure fluctuations within the circulating system to vary its volume and serve as a surge suppressor and thereby produce an oscillating paint movement within the dead-end drop to provide sufficient agitation to minimize the settling of paint particles.

SUMMARY OF THE INVENTION

In the practice of the invention, a paint circulation system utilizes a circulating pump of the turbine type to circulate paint in a closed loop network. The loop includes a plurality of valved paint distributors for applying the paint to the desired surfaces. A positive displacement paint injection pump communicates with the closed circuit and is powered by a "smart" electric motor whose rate of revolution, power consumption, resistance to rotation, and other physical characteristics are sensed by a monitored direct current microprocessor operated control system whereby the amount of paint introduced into the circulation system by the injector pump is closely determined, monitored and regulated. The injector pump is supplied from a paint reservoir.

The injector pump is calibrated to maintain a predetermined pressure within the paint circulation network regardless of the rate of removal of paint from the network by the distributors. As the injector pump maintains a uniform pressure on the outlet side of the circulating pump, the amount of paint being supplied to the circulation system is being determined and monitored by the injector pump motor.

In an embodiment of the invention, a bypass or "leakage" passageway communicates with the paint circulation system on the inlet side of the circulation pump for discharging into the paint reservoir supplying the injector pump. This bypass conduit includes a restrictor of predetermined size, and upon the injector pump motor determining the volume of makeup paint required to maintain a given pressure within the circulation system when all of the valve distributors are closed the rate of flow through the bypass passage may be accurately determined, and hence, the viscosity of the paint monitored.

By locating an automatic timer valve within the bypass or leakage conduit, the opening and closing of the timer valve will produce pulses within the circulation network resulting in a pulsing of the movement of paint through the circulation network. Such pulses discourage settling and degradation of the paint particles within the circulation network, and the use of the timed valve to produce pulses permits the paint to circulate at a slower rate than usual extending the useful life of the paint, and avoiding significant settling.

The bypass passage or leakage passage may be supplied by a slinger ring within the circulating pump receiving paint leaking between the pump shaft and a bearing. The shaft and bearing produce a restriction in the leakage passage providing an indication of the viscosity of the paint, and as the pump bearing wears the restriction will increase in area giving a reading provided by the injector pump motor to alert the operator of the circulating pump wear so as to perform the necessary maintenance to prevent a breakdown.

The injector pump supply for a circulating paint network may be used with a painting system employing dead-end drops wherein the valve distributors are located at the lower end of blind hose lines, or the like. While such dead-end drop paint distributors have a number of advantages, a serious deficiency results from the fact that if the distributor associated with the drop is not regularly used the paint will settle in the lower regions of the drop conduit producing an inconsistent composition. The invention contemplates employing an oscillation reservoir at the lower end of the dead-end drops which consists of a variable volume chamber utilizing a spring biased piston. As the pressure within the paint circulation system increases the volume in the oscillation reservoir increases, and as the paint pressure reduces the spring displaces the piston to reduce the oscillation reservoir volume. Such movement of the reservoir piston produces an oscillating paint flow within the dead-end drop keeping the paint in motion, which discourages settling and other degradation.

Brief Description of the Drawings

The aforementioned objects and advantages of the invention will be appreciated from the following description and accompanying drawings wherein:

FIG. 3 is a schematic view of a paint circulation system similar to that of FIG. 2 illustrating a bypass or leakage passage between the circulating pump inlet and the injector pump paint supply reservoir, FIG. 4 is a schematic view of a paint circulation system employing dead-end drops and oscillation reservoirs in conjunction with an injection pump, FIG. 5 is a detail schematic view of a circulating pump shaft, bearing and slinger ring providing an orifice to regulate paint flow through the bypass passage to determine pump wear, and FIG. 6 is a schematic detail view of an oscillation reservoir used in conjunction with a dead-end drop in the paint circulation system shown in FIG. 4.

DESCRIPTION OF THE PREFERRED EMBODIMENTS

Figure 1:
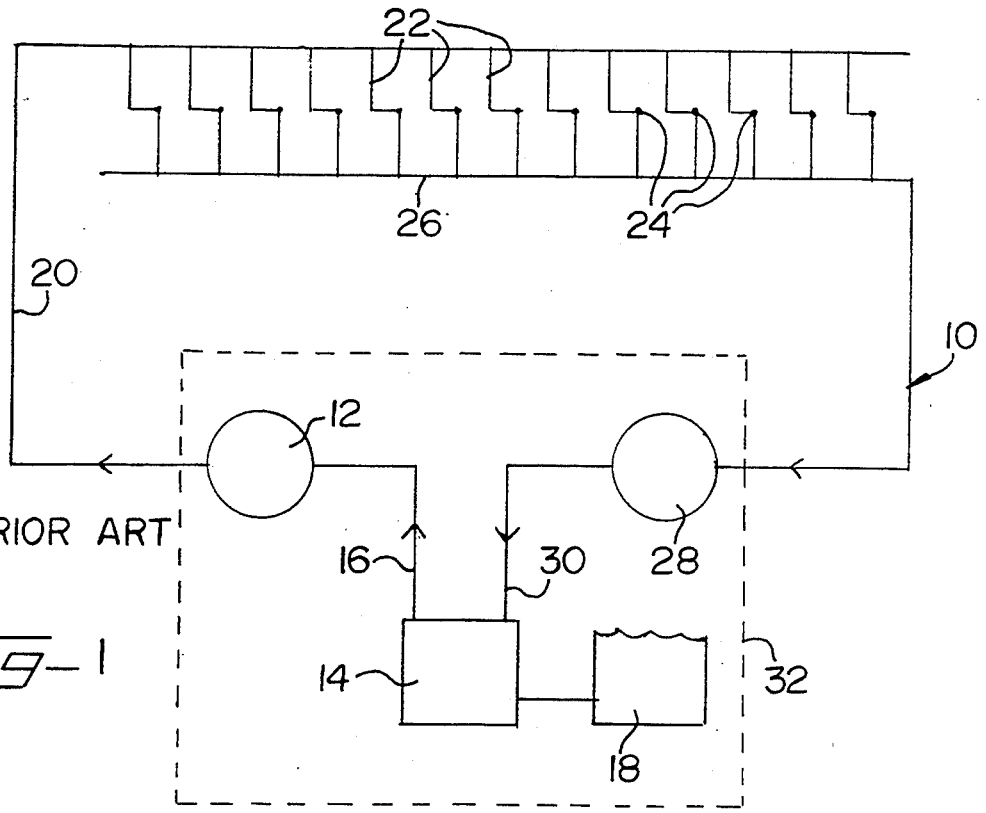
FIG. 1 is a schematic view of a typical prior art paint circulation system using a plurality of valved paint distributors.

FIG. 1 illustrates a typical prior art paint circulation system over which the invention is an improvement. Such a paint circulation system includes a basic circulation network 10 consisting of a circulation pump 12, a paint reservoir 14 which supplies the pump 12 through the conduit 16, and the reservoir 14 is supplied with paint from a mixing tank 18. The output of the pump 12 passes into conduit 20 which supplies a manifold to a plurality of parallel connected stations 22 each station having a valved paint distributor 24 in the form of a manually held spray gun or fixed or robotically controlled nozzle for applying paint to the work piece, not shown. The stations 22 communicate with the return line 26 continuing the back pressure control valve 28 which dumps into the reservoir 14 through pipe 30. The dotted line 32 represents the paint mix room in which the operating components, other than the paint stations and distributors, are located.

Normally, conventional paint systems of the type shown in FIG. 1 circulate the paint through the network 10 at approximately sixty feet per minute, and the flow of paint through the network 10 is substantially constant as regulated by the pressure control valve 28. The greater the number of paint distributors 24 in use, the greater the amount of paint being pumped by pump 12 in order to maintain a substantially constant pressure within network 10, and even though little paint is being used in view of the majority of distributors 24 being closed the velocity of the paint flowing through the network 10 is maintained substantially at sixty feet per minute.

The circulation of paint through the network 10 at sixty feet per minute degrades the paint over a period of time due to its continuous recycling through the pump 12, valve 28 and reservoir 14, as well as the associated piping and conduits, and "flake" paint in which small particles of aluminum are mixed is adversely affected by the velocity and recycling of the paint being circulated in network 10.

Figure 2:
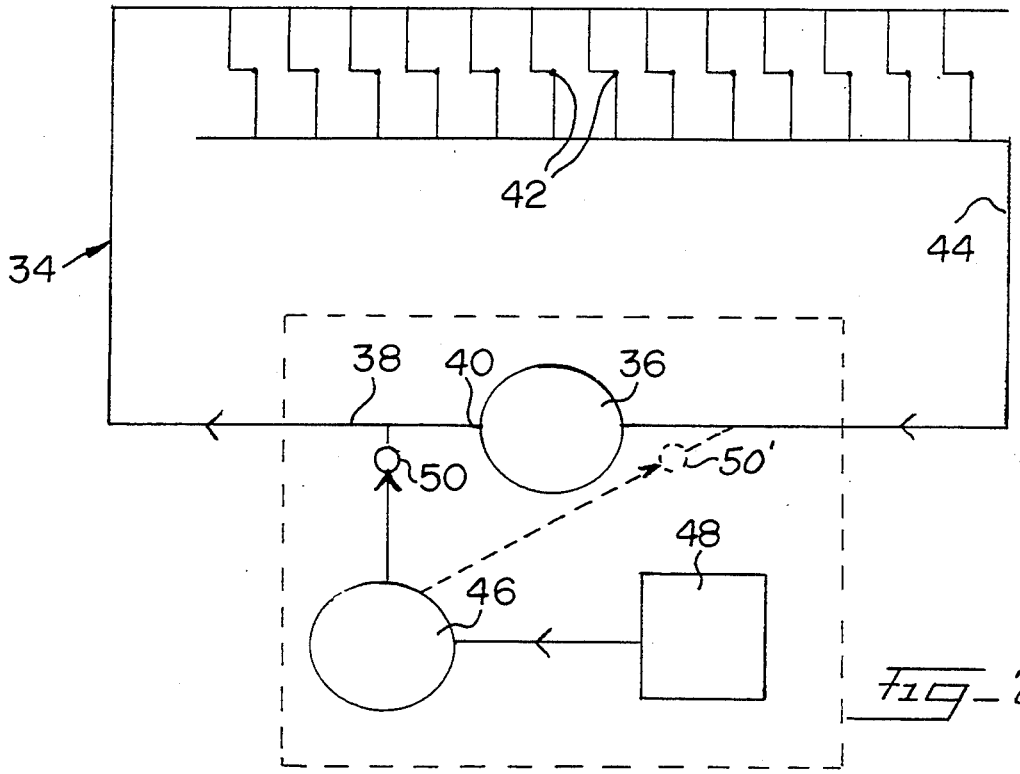
FIG. 2 is a schematic of a paint distribution system utilizing the concepts of the invention wherein makeup paint is supplied by an injection pump.

FIG. 2 illustrates an improvement in a paint circulation system over the assignee's U.S. Pat. No. 4,653,532 and the circulation network is generally indicated at 34 and is supplied by a turbine type axial flow circulating pump 36. Preferably, the circulating pump 36 is such as manufactured by the assignee, Graco Inc. of Minneapolis, Minn., Model No. Series 223 or 224. The circulating pump 36 supplies the conduit 38 through the pump outlet 40, and the conduit 38 communicates with a plurality of parallel circuit valve distributors 42 constituting spray guns or nozzles. The return line is indicated at 44, and the recirculated paint is directly connected to the inlet of the pump 36.

In the circulation network 34 the pump 36 is adjusted to circulate the paint within network 34 at only thirty feet per minute, and this slower paint velocity through the network significantly decreases paint settling and paint degradation. However, when paint is being used by the valve distributors 42 the paint within network 34 must be replaced, and such paint replenishment is accomplished by a "smart" injection pump 46 in communication with the pump outlet conduit 38. The injection pump 46 is preferably of the type manufactured by the assignee, Graco Inc., Triumph Series 220, as powered by a "smart" electric motor capable of sensing the output, torque volume and other characteristics of the paint being pumped, such motor and pump being described in assignee's U.S. Pat. No. 5,220,259 and Ser. No. 07/857,459 filed Mar. 25, 1992, the disclosures thereof being incorporated herein by reference. U.S. Pat. No. 5,220,259 discloses a direct current motor drive system for a linearly-reciprocable liquid pump capable of being used with assignee's painting systems. This motor control includes a microprocessor whereby the motor control may be adjusted to maintain the pumped liquid at a pre-determined pressure and flow rate. The motor speed and current during pumping are monitored which provides an indication of the pressure within network 34 and the amount of paint introduced into the network during painting and during paint circulation. A flow meter 50 may be included in the piping between injection motor 46 and network conduit 38 if a "smart" injection pump capable of metering is not used, but as the injection pump 46 is capable of metering the volume of paint being pumped the use of a separate volume meter 50 is optional.

In the paint circulation network 34 shown in FIG. 2 the pressure of the paint within conduit 38 may typically be maintained at 200 psi, while the pressure within return line 44 will be at approximately 100 psi. Upon the pressure within conduit 38 being reduced due to the use of paint at the distributors 42, the injection pump 46 will sense such reduction in the pressure within conduit 38 by a change in the pump motor current, and begin injecting paint into conduit 38 to maintain the pressure therein at 200 psi. Accordingly, the amount of paint being injected into conduit 38 by injection pump 46 will be dependent upon the rate of pump usage at the valved distributors 42. Accordingly, the paint circulation system shown in FIG. 2 permits a slower velocity of paint movement through the network 10, yet maintains the desired pressure within the network required for effective painting and ejection through the distributors 42, and in periods of little or no paint usage, the flow of paint through the network 10 will be at the reduced flow rate to reduce paint settling and degradation problems.

In the description of FIG. 2, the output of the injection pump 46 is connected to the circulation pump output 38. However, as indicated in dotted lines in FIG. 2, the output of the injection pump may be, alternatively, connected to the return line 44, and a flow meter 50' may be optionally included in this alternate connection of the injector pump to the circulating network 34. The preferred arrangement is as shown in full lines in FIG. 2, but the dotted line conduit arrangement may be used if desired.

FIG. 3 illustrates a paint circulation system having many similarities to the circulation system shown in FIG. 2, and identical components are indicated by primes. The paint circulation system shown in FIG. 3 operates in the manner identical to the system of FIG. 2 except with respect to the following.

In the circuit of FIG. 3, a bypass or "leakage" passage conduit 52 communicates with the circulation network 34' adjacent the inlet of the circulation pump 36' and the bypass or leakage conduit 52 may optionally include an automatically operated timer valve 54 for opening and closing the passage 52.

The passage 52 includes a flow restrictor 53, such as a predetermined sized orifice, wherein the rate of paint flowing through the passage 52 to the injection pump paint supply receptacle 48' is determined by the viscosity of the paint within the circulation network 34'. The more viscous the paint, the slower the rate of flow through the bypass passage 52. Accordingly, when all of the valve distributors 42' are closed the loss of paint from the circulation network 34' through the leakage passage 52 will be directly related to the rate the paint flows through the restriction within the passage 52, and as the injection pump 46' is capable of metering and indicating the amount of paint it introduces into the circulation network 34' by monitoring the pump motor characteristics to maintain the desired pressure an evaluation of the amount of paint necessary to be introduced into network 34' by injection pump 46' permits an electronic determination of the viscosity of the paint within circulation network 34' at all times. Of course, such determination of the viscosity requires a close control of the paint pressures within the network conduits 38' and return line 44', but such close pressure controls can be readily maintained by the motor control of the injection pump 46'.

For viscosity sensing, only, the leakage passage 52 need not include the automatic timer valve 54. However, when the timer valve 54 is incorporated into the passage 52, and this timer valve, at a predetermined timed sequence, alternately opens and closes, a pulsation of the pressure within the circulation network 34' will occur, and such pulsation will reduce paint settling and degradation.

FIG. 4 illustrates the utilization of the inventive concepts in a paint circulation system employing dead-end drop paint distribution stations.

With reference to FIG. 4, the paint circulation network generally indicated at 56 includes a circulation pump 58 of the type previously described, and the pump 58 supplies a plurality of dead-end drop distribution stations 60. Each of the dead-end drop stations 60 constitute blind lines having a valved paint distributor located at the ends thereof, and the circulation of paint through the network 56 is achieved by the return line 62 communicating with the inlet of the pump 58. The injection pump 64 senses the pressure within the network 56 at the outlet of the circulating pump 58, and the injection pump 64 is supplied with paint from the supply reservoir 66. The pump 64 is connected to the network 56 through conduit 68.

Adjacent the end of each dead-end drop station 60 a fitting 70 is located to which the valve distributor, not shown, is attached, FIG. 6. Adjacent the fitting 70 an oscillation reservoir 72 communicates with the dead-end drop line 60, and the reservoir 72 basically comprises a cylinder having a reciprocal piston 74 mounted therein biased by a compression spring 76, as will be appreciated from FIG. 6.

The injection pump 64 is programmed to supply paint to the network 56 to maintain a normal pressure of 200 psi, but additionally, the pump 64 provides a periodic oscillating pressure of approximately 300 psi to the network 56. The periodic application of the oscillation pressure to the network 56 causes the piston 74 to compress the spring 76 increasing the volume within the oscillation reservoir 72. Upon removal of the oscillation pressure from the circulation network the spring 76 will expand decreasing the volume within the oscillation reservoir 72, and the alternate expansion and reduction of volume within reservoir 72 causes an alternate direction paint flow within the dead-end drop stations 60 regardless of whether or not paint is being ejected from the associated valve distributor.

Previously, dead-end drop paint stations had the problem of paint settling due to inactivity of the associated distributor. However, with the use of the oscillation reservoir 72 paint movement within the dead-end drops 60 occurs within the dead-end drops regardless of whether paint is being ejected through the associated distributor, and paint settling is decreased. Further, the oscillation reservoir 72 functions as a surge suppressor and will serve to absorb pressure surges in the network 56.

With respect to the above description of FIG. 3, it is possible that the bypass or leakage conduit 52 be so oriented to the circulation pump 36' that the wearing condition of the circulation pump 36' can be monitored.

With reference to FIG. 5, a shaft 78 of the circulation pump 36' is supported within a bearing 80, and the bearing 80 will slowly wear in the normal operation of the circulating pump. The shaft portion 82 upon the opposite side of the bearing 80 is subjected to the upward pressure of the circulation pump, and a slow flow of paint will occur through the bearing 80 in an axial direction to the slinger collar 84 mounted upon the upper portion of the shaft 78 as shown in FIG. 5. The slinger collar 84 is connected to a conduit 86 which communicates with the passage 52, or directly communicates with the tank 48'. It will be appreciated that when the leakage passage shown in FIG. 5 is used the leakage passage arrangement of FIG. 3 is not used.

In the arrangement of FIG. 5, the leakage of paint through the bearing 80 can be calibrated whereby the viscosity of the paint within the network 34' can be determined, as described above. However, as wear occurs at the bearing 80 a greater amount of paint will flow through the bearing, and this fact will be sensed by the motor control of the injection pump 46' producing a readout which will indicate to the operator the condition of the bearing 80 so that preventive maintenance may be scheduled.

As the injection pump 46' disclosed measures and reports both pressure and flow, by the monitoring of the speed and current of the injection pump motor viscosity and bearing wear may be readily determined by the injection pump, as well as the volume of paint being pumped and introduced into the circulation network.

By monitoring the characteristics of the injection pump motor, it is also possible with the embodiments of FIGS. 3 and 5 to predict the wear condition of the associated injection pump, as the injection pump wears, the calculated viscosity will differ from an actual viscosity measurement because of erroneous flow measurement by the injection pump, and an erroneous viscosity calculation is an indication of pump wear.

The injection pump used in the practice of the invention can be remotely controlled to increase or decrease pressure, and the variable pressure range permits a variety of shear rates within the bypass passage and permit viscosity measurements at varying shear rates.

The advantages of the paint circulation system of the embodiments described above are many. Because the amount of paint being distributed by the valves' distributors can be accurately determined by the microprocessor controlled motor control of the injection pump, paint cost management can be accurately controlled and the efficiency of the paint application system closely monitored. Further, the Environmental Protection Agency often requires reports with respect to the amount of paint being used by manufacturers.

Reduced paint degradation occurs in that back pressure regulators can be eliminated and less degradation occurs in the circulation pump due to the ability of the paint circulation system to use lower velocities than with prior systems. Energy consumption is reduced, improved paint maintenance programs can be implemented, and improved uniformity of paint is achieved. The injection pump permits high system pressures without necessitating expensive equipment, and the system provides periodic reports on paint viscosity and pump wear in order to achieve a more uniform product and anticipate potential breakdowns.

It is appreciated that various modifications to the inventive concepts may be apparent to those skilled in the art without departing from the spirit and scope of the invention.

We claim:

1. The method of circulating paint within a paint circulation network having a predetermined operating pressure wherein the network includes a circulating pump having an outlet and an outlet pressure and an inlet for continuously circulating paint through the network, a valved paint distributor within the network and a paint supply, comprising the steps of:

(a) continuously circulating paint within the network while bypassing the paint supply, (b) sensing the network pressure at the circulating pump outlet, (c) injecting paint from the paint supply into the network in communication with the circulating pump outlet to substantially maintain the predetermined operating pressure, and (d) metering the amount of paint injected into the network from the paint supply to determine paint usage.

2. The method of circulating paint as in claim 1 including the steps of leaking paint from the network through a predetermined restriction to the paint supply when the valved paint distributor is closed and sensing the rate of leaking paint through the predetermined restriction to evaluate the paint viscosity.

3. The method of circulating paint as in claim 1, the circulation network including dead-end drop conduits each having a valved paint distributor including the step of momentarily varying the paint pressure within the network and varying the volume of paint within the dead-end drop conduits regardless of the operative condition of the associated valved paint distributor in accordance with the paint pressure within the network to produce paint flow therein to reduce paint settling.

4. The method of circulating paint as in claim 1 including the steps of leaking paint from the network to the paint supply through a wear surface of the circulating pump when the valved paint distributor is closed and sensing the rate of leaking paint through the wear surface of the circulating pump to the paint supply to evaluate the wear of the circulating pump.

5. The method of circulating paint as in claim 2, including the step of periodically momentarily interrupting the leaking of paint from the network when the valved paint distributor is closed to vary the pressure within the network to decrease paint settling and degradation.

* * * * *